US009366251B2

(12) United States Patent
Sugihara et al.

(10) Patent No.: US 9,366,251 B2
(45) Date of Patent: Jun. 14, 2016

(54) VANE PUMP WITH A VANE RING, A VANE RING HOUSING CHAMBER AND VANE RING OPPOSITE PRESSURE CHAMBERS

(71) Applicant: KAYABA INDUSTRY CO., LTD., Minato-ku, Tokyo (JP)

(72) Inventors: Masamichi Sugihara, Kani (JP); Tomoyuki Fujita, Kani (JP); Koichiro Akatsuka, Gifu (JP)

(73) Assignee: KYB Corporation, Tokyo (JP)

( * ) Notice: Subject to any disclaimer, the term of this patent is extended or adjusted under 35 U.S.C. 154(b) by 0 days.

(21) Appl. No.: 14/349,428

(22) PCT Filed: Sep. 27, 2012

(86) PCT No.: PCT/JP2012/074836

§ 371 (c)(1),
(2) Date: Apr. 3, 2014

(87) PCT Pub. No.: WO2013/051448

PCT Pub. Date: Apr. 11, 2013

(65) Prior Publication Data

US 2014/0234150 A1 Aug. 21, 2014

(30) Foreign Application Priority Data

Oct. 3, 2011 (JP) ..... 2011-219301

(51) Int. Cl.
*F03C 2/00* (2006.01)
*F03C 4/00* (2006.01)
(Continued)

(52) U.S. Cl.
CPC ..... *F04C 2/344* (2013.01); *F01C 21/0836* (2013.01); *F01C 21/0863* (2013.01); *F01C 21/108* (2013.01); *F04C 2/3446* (2013.01); *F04C 2240/20* (2013.01); *F04C 2240/801* (2013.01)

(58) Field of Classification Search
CPC ..... F01C 21/0836; F01C 21/0845; F01C 21/0863; F01C 21/0809; F01C 21/108; F04C 2/344; F04C 2/3446; F04C 2240/20; F04C 2240/801
USPC ..... 418/259, 260, 266–268, 82, 133
See application file for complete search history.

(56) References Cited

U.S. PATENT DOCUMENTS 6,634,876 B2 * 10/2003 Osugi ..... F01C 21/0836 418/260

FOREIGN PATENT DOCUMENTS

DE 3423812 A1 2/1985
JP 5-57384 U 7/1993
(Continued)

OTHER PUBLICATIONS

Office Action dated Jul. 3, 2015, corresponding to Chinese patent application No. 201280048450.7.
(Continued)

*Primary Examiner* — Theresa Trieu
(74) *Attorney, Agent, or Firm* — Hauptman Ham, LLP

(57) ABSTRACT

A vane pump includes a rotor, slits which are radially formed in the rotor, vanes which slidably project from the slits, vane back pressure chambers which are defined between the base end parts of the vanes and the slits, a cam ring with which the tip parts of the vanes slide in contact, a pump chamber which is defined among the cam ring, the rotor and adjacent vanes, a vane ring which faces the base end parts of the vanes, a vane ring housing chamber on which one end of each slit is open and in which the vane ring is housed, and vane ring opposite pressure chambers on which the other ends of the slits are open and which cause a fluid pressure to act in a direction to push the rotor toward the vane ring.

4 Claims, 8 Drawing Sheets

(51) Int. Cl.

| | |
|---|---|
| ***F04C 2/00*** | (2006.01) |
| ***F04C 18/00*** | (2006.01) |
| ***F04C 2/344*** | (2006.01) |
| ***F01C 21/08*** | (2006.01) |
| ***F01C 21/10*** | (2006.01) |

(56) References Cited

FOREIGN PATENT DOCUMENTS

| | | | |
|---|---|---|---|
| JP | 2004-360473 | A | 12/2004 |
| JP | 2005-120894 | A | 5/2005 |
| JP | 2006-233767 | A | 9/2006 |
| JP | 2006-299873 | A | 11/2006 |

OTHER PUBLICATIONS

International Search Report mailed Dec. 18, 2012, in corresponding International Application No. PCT/JP2012/074836.

* cited by examiner

VANE PUMP WITH A VANE RING, A VANE RING HOUSING CHAMBER AND VANE RING OPPOSITE PRESSURE CHAMBERS

RELATED APPLICATIONS

The present application is a National Phase of International Application Number PCT/JP2012/074836, filed Sept. 27, 2012, which claims priority to Japanese Application Number 2011-219301, filed Oct. 3, 2011.

TECHNICAL FIELD

The present invention relates to a vane pump used as a fluid pressure supply source.

BACKGROUND ART

A vane pump includes a plurality of vanes housed in radial slits of a rotor. Each vane is biased in a direction to project from the slit by a hydraulic force of a vane back pressure chamber for pressing a base end part of the vane and a centrifugal force acting on the vane with the rotation of the rotor and a tip part of the vane slides in contact with an inner peripheral cam surface of a cam ring. The vanes sliding in contact with the inner peripheral cam surface reciprocate along the slits as the rotor rotates, whereby pump chambers expand and contract. Hydraulic oil pressurized in the pump chambers is discharged from discharge ports open on a side plate to a discharge pressure chamber in the vane pump and supplied from the discharge pressure chamber to a hydraulic device.

In such a vane pump, when the rotation of the rotor is stopped, the vanes located above the rotor fall toward the backs of the slits by gravity. Thus, there is a possibility that projecting movements of the vanes from the slits are delayed and a pump discharge pressure rises at a delayed timing at the start-up when the rotor is rotated again.

Accordingly, JP2004-360473A discloses a vane pump provided with a vane ring projecting in an axial direction of a rotor from a side plate. Since the vane ring holds base end parts of vanes when the rotation of the rotor is stopped, the vanes can be held in a state forcibly projected from slits.

The above vane pump includes a vane ring housing groove which is open on one end surface (side surface) of the rotor and in which the vane ring is housed, and a plurality of oil sump recesses which are open on the other end surface of the rotor and into which a pump discharge pressure is intermittently introduced. Since this causes pump-discharged oil to be supplied to the vane ring housing groove and each oil sump recess, an oil film is formed in a clearance between the rotor and the side plate to prevent seizure due to sliding contact.

SUMMARY OF INVENTION

However, since openings of the slits and the oil sump recesses are partitioned from each other on the end surface of the rotor in the above vane pump, pressure distributions of each oil sump recess and the vane ring housing groove are caused to have different values by an operation of expanding and contracting vane back pressure chambers through reciprocal movements of the vanes. Thus, there is a possibility that the rotor is pressed against the side plate, sliding resistance of the rotor increases and the oil film disappears to cause seizure.

An object of the present invention is to provide a vane pump capable of equalizing fluid pressure distributions produced at a side where a vane ring of a rotor is provided and an opposite side.

According to one aspect of the present invention, a vane pump used as a fluid pressure supply source is provided. The vane pump comprises a rotor which is driven and rotated; a plurality of slits which are radially formed in the rotor; a plurality of vanes which slidably project from the slits; vane back pressure chambers which are defined between the base end parts of the vanes and the slits; a cam ring with which the tip parts of the vanes slide in contact as the rotor rotates; a pump chamber which is defined among the cam ring, the rotor and adjacent vanes; a vane ring which faces the base end parts of the vanes; a vane ring housing chamber on which one end of each slit is open and in which the vane ring is housed; and vane ring opposite pressure chambers on which the other ends of the slits are open and which cause a fluid pressure to act in a direction to push the rotor toward the vane ring.

Embodiments of the present invention and advantages thereof are described in detail below with reference to the accompanying drawings.

DESCRIPTION OF EMBODIMENTS

Hereinafter, embodiments of the present invention are described with reference to the accompanying drawings.

First, a first embodiment is described.

Figure 1:
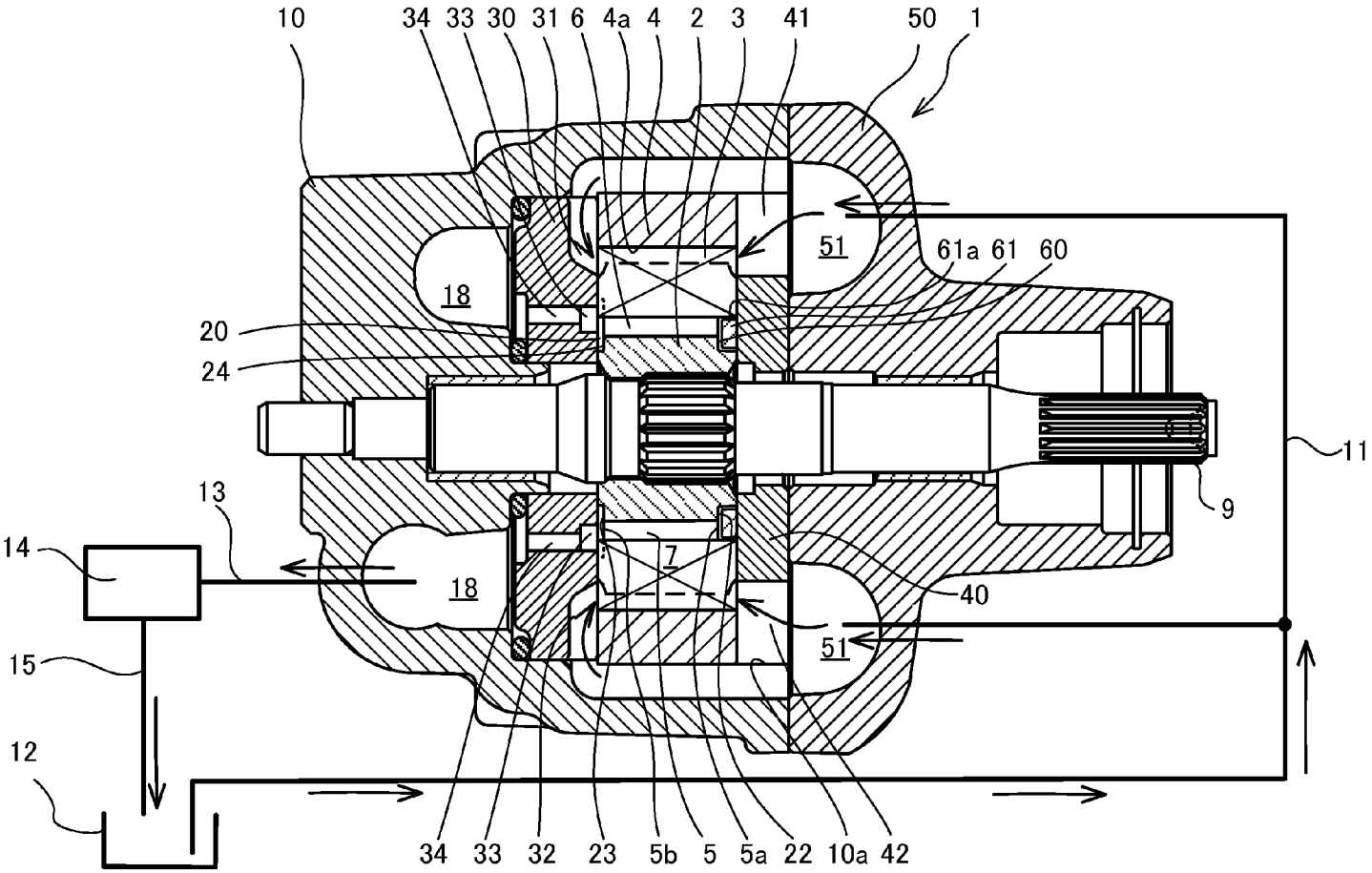
FIG. 1 is a sectional view of a vane pump according to a first embodiment of the present invention.
Figure 2:
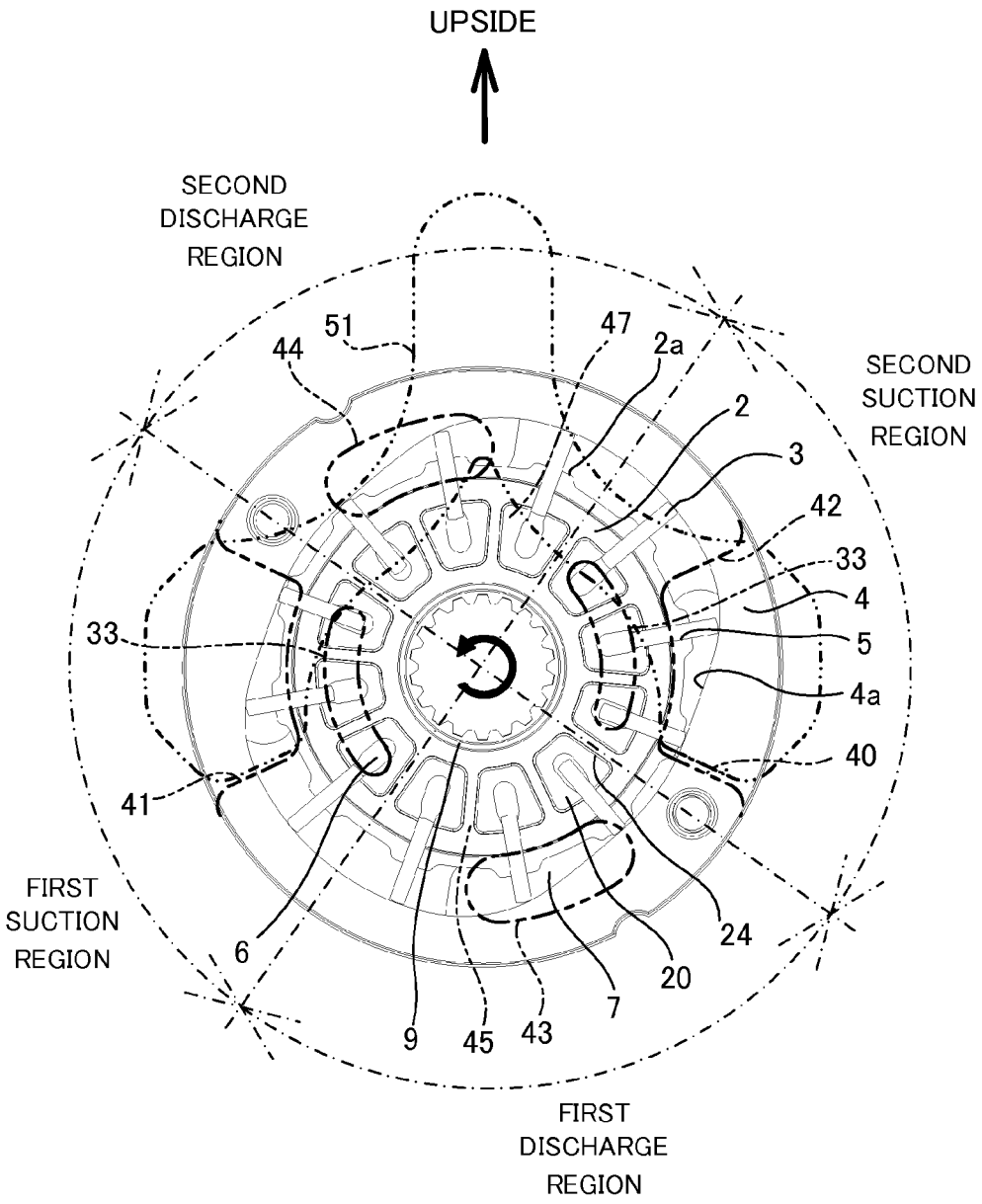
FIG. 2 is a rear view showing passages of the vane pump.

FIG. 1 is a sectional view of a vane pump according to the present embodiment, and FIG. 2 is a rear view showing passages of the vane pump. The vane pump 1 is used as a hydraulic pressure supply source for a hydraulic device 14 mounted in a vehicle such as a power steering device or a transmission.

Although the vane pump 1 uses hydraulic oil (oil) as working fluid, working liquid such as water-soluble alternative liquid may be used instead of the hydraulic oil.

The vane pump 1 includes a drive shaft 9 as a rotary shaft. Power of an engine, an electric motor or the like (not shown) is transmitted to an end part of the drive shaft 9. A rotor 2 coupled to the drive shaft 9 with the rotation of the drive shaft 9 rotates in a direction shown by an arrow of FIG. 2.

The drive shaft 9 is rotatably supported on a pump body 10 and a pump cover 50. The pump body 10 is formed with a pump housing recess 10*a*. The rotor 2, a cam ring 4, a body-side side plate 30, a cover-side side plate 40 and the like are housed in the pump housing recess 10*a*. The pump cover 50 is fastened to the pump body 10 and the pump housing recess 10*a* is sealed by this pump cover 50.

A discharge pressure chamber (high pressure chamber) 18 is defined between a bottom part of the pump housing recess 10*a* and the body-side side plate 30. The body-side side plate 30 is pressed against the rear (left in FIG. 1) end surface of the cam ring 4 by a pump discharge pressure introduced into the discharge pressure chamber 18. This causes the front (right in FIG. 1) end surface of the cam ring 4 to be pressed against the cover-side side plate 40 and further causes the front end surface of the cover-side side plate 40 to be pressed against the pump cover 50.

The vane pump 1 includes a plurality of vanes 3 which are provided radially reciprocally movable relative to the rotor 2 and the cam ring 4 which houses the rotor 2 and the vanes 3. When the rotor 2 rotates, tip parts of the vanes 3 slide in contact with an inner peripheral cam surface 4*a* of the cam ring 4.

The rotor 2 is formed with slits 5 radially extending and arranged at regular intervals. The slits 5 include openings on an outer peripheral surface 2*a* of the rotor 2. The vane 3 is in the form of a substantially rectangular flat plate and slidably inserted into the slit 5.

Inside the cam ring 4, a plurality of pump chambers 7 are defined by the outer peripheral surface 2*a* of the rotor 2, the inner peripheral cam surface 4*a* of the cam ring 4 and adjacent vanes 3.

The cam ring 4 is an annular member having the substantially elliptical inner peripheral cam surface 4*a*. Accordingly, as the rotor 2 rotates one turn, each vane 3 following the inner peripheral cam surface 4*a* reciprocates twice.

As shown in FIG. 2, the vane pump 1 has a first suction region and a first discharge region where the vanes 3 make the first reciprocal movement and a second suction region and a second discharge region where the vanes 3 make the second reciprocal movement. The pump chamber 7 expands in the first suction region, contracts in the first discharge region, expands in the second suction region and contracts in the second discharge region.

As just described, the vane pump 1 includes two suction regions and two discharge regions. However, without being limited to this, the vane pump 1 may have one, three or more suction regions and one, three or more discharge regions.

First suction ports 31, 41 are respectively open in the first suction region and second suction ports 32, 42 are respectively open in the second suction region on end surfaces 39, 40 (see FIG. 4) of the body-side side plate 30 and the cover-side side plate 40 with which the rotor 2 slides in contact.

A suction pressure chamber 51 is formed on a surface of the pump cover 50 facing the cover-side side plate 40. The suction pressure chamber 51 communicates with a tank 12 via a suction passage 11 and communicates with the first suction ports 31, 41 and the second suction ports 32, 42.

When the vane pump 1 is actuated, the working fluid in the tank 12 is supplied to the pump chambers 7 by successively passing through the suction passage 11, the suction pressure chamber 51, the first suction ports 31, 41 and the second suction ports 32, 42 as shown by arrows in FIG. 1.

On the end surface of the body-side side plate 30 with which the rotor 2 slides in contact, a first discharge port 43 is open in the first discharge region and a second discharge port 44 is opened in the second discharge region.

The first and second discharge ports 43, 44 are respectively open on the discharge pressure chamber 18 defined between the pump body 10 and the body-side side plate 30. The discharge pressure chamber 18 communicates with the hydraulic device (fluid pressure supply destination) 14 via a discharge passage 13.

When the vane pump 1 is actuated, the pressurized working fluid discharged from the pump chambers 7 is supplied to the hydraulic device 14 by successively passing through the first and second discharge ports 43, 44, the discharge pressure chamber 18 and the discharge passage 13. The working fluid discharged from the hydraulic device 14 is returned to the tank 12 through a return passage 15.

A vane back pressure chamber 6 is defined between a back side of the slit 5 and a base end part of the vane 3.

Two back pressure ports 33 are formed on the end surface 39 (see FIG. 4) of the body-side side plate 30 with which the rotor 2 slides in contact. The back pressure ports 33 are formed into arcs centered on an axis of rotation of the rotor 2 and extending side by side and respectively communicate with the vane back pressure chambers 6 in the first and second suction regions. No back pressure port is provided in the first and second discharge regions.

The body-side side plate 30 is formed with a plurality of discharge pressure introducing through holes 34 allowing communication between the discharge pressure chamber 18 and each back pressure port 33. This causes each vane back pressure chamber 6 to intermittently communicate with the back pressure ports 33 with the rotation of the rotor 2 and causes the pump discharge pressure produced in the discharge pressure chamber 18 to be introduced from each discharge pressure introducing through hole 34 to each vane back pressure chamber 6 through the back pressure ports 33 when the vane pump 1 is actuated. By this pump discharge pressure, the vanes 3 are biased in a direction to project from the slits 5.

When the vane pump 1 is actuated, the vanes 3 are biased in the direction to project from the slits 5 by fluid pressures of the vane back pressure chambers 6 pressing the base end parts of the vanes 3 and a centrifugal force acting with the rotation of the rotor 2, and the tip parts of the vanes 3 slide in contact with the inner peripheral cam surface 4*a* of the cam ring 4. Since the vanes 3 sliding in contact with the inner peripheral cam surface 4*a* reciprocally move with the rotation of the rotor 2, the pump chambers 7 expand and contract and the working fluid pressurized in the pump chambers 7 is discharged from the discharge ports 43, 44 to the discharge pressure chamber 18.

The vane pump 1 includes a vane ring 61 projecting inwardly of the rotor 2 from the cover-side side plate 40. An outer peripheral surface 61*a* of the vane ring 61 faces the base end parts of the vanes 3 and prevent the depression of the vanes 3 when the rotation of the rotor 2 is stopped. When the rotation of the rotor 2 is stopped, the vanes 3 located above the rotor 2 begin to fall to the backs of the slits 5 by gravity, but the base end parts thereof come into contact with the outer peripheral surface 61*a* of the vane ring 61, whereby the depression of the vanes 3 is prevented.

The outer peripheral surface 61*a* of the vane ring 61 has a shape (substantially elliptical shape) substantially similar to the inner peripheral cam surface 4*a* of the cam ring 4. Accordingly, a distance between the inner peripheral cam surface 4*a* and the outer peripheral surface 61*a* in a radial direction of the rotor 2 is substantially constant over the entire circumference. Since the base end parts of the vanes 3 slide in contact along the outer peripheral surface 61*a* of the vane ring 61 when the rotation of the rotor 2 is started, the vanes 3 are forcibly projected from the slits 5 even in an initial stage of the rotation.

The vane ring 61 is formed by a member different from the cover-side side plate 40 and fastened to the cover-side side plate 40. It should be noted that the vane ring 61 may be integrally formed with the cover-side side plate 40.

Further, the vane ring 61 may be configured by a plurality of guide members or may be configured by a plurality of projections integrally formed with the cover-side side plate 40 without being limited to having a ring shape (annular shape).

Figure 3A:
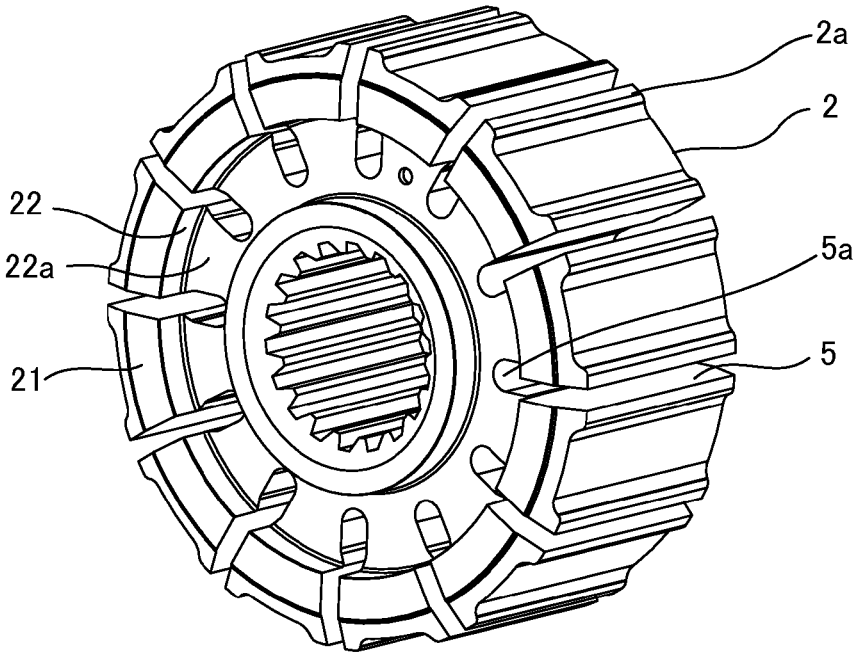
FIG. 3A is a perspective view of a rotor when viewed from front.
Figure 3B:
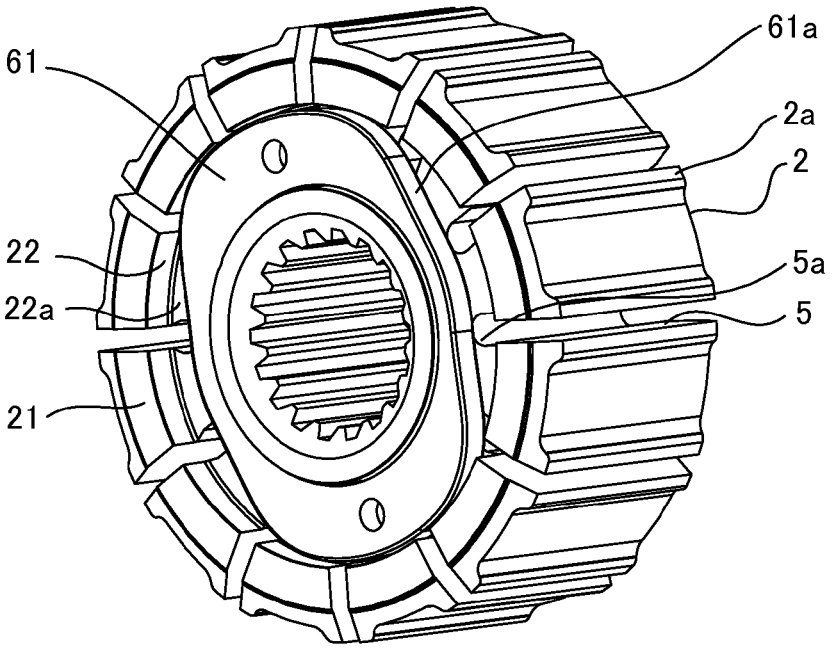
FIG. 3B is a perspective view of the rotor with a vane ring interposed when viewed from front.

FIG. 3A is a perspective view showing a front side (right side in FIG. 1) of the rotor 2. FIG. 3B is a perspective view showing a state where the vane ring 61 is interposed in the rotor 2. A vane ring housing groove 22 in which the vane ring 61 is housed is formed in a cover-side end surface 21 of the rotor 2. The circular ring-shaped vane ring housing groove 22 is formed concentrically with a rotation center axis of the rotor 2.

Back parts of the slits 5 are open on the vane ring housing groove 22. The base end parts of the vanes 3 housed in the slits 5 face in such a manner as to be able to come into contact with the outer peripheral surface 61*a* of the vane ring 61.

When a rotation stopped state of the rotor 2 continues, the vanes 3 located above the rotor 2 and in the second suction region and the second discharge region slightly fall by gravity, and the base end parts of the vanes 3 come into contact with the outer peripheral surface 61*a* of the vane ring 61. Since this prevents the depression of the vanes 3, a state is maintained where the tip parts of the vanes 3 proximately face the inner peripheral cam surface 4*a*.

Since the pump chambers 7 are defined in advance in the state where the tip parts of the vanes 3 are proximate to the inner peripheral cam surface 4*a* when the vane pump 1 is actuated, the pump chambers 7 can quickly expand and contract with the rotation of the rotor 2 and the rise of the pump discharge pressure can be improved.

Figure 4:
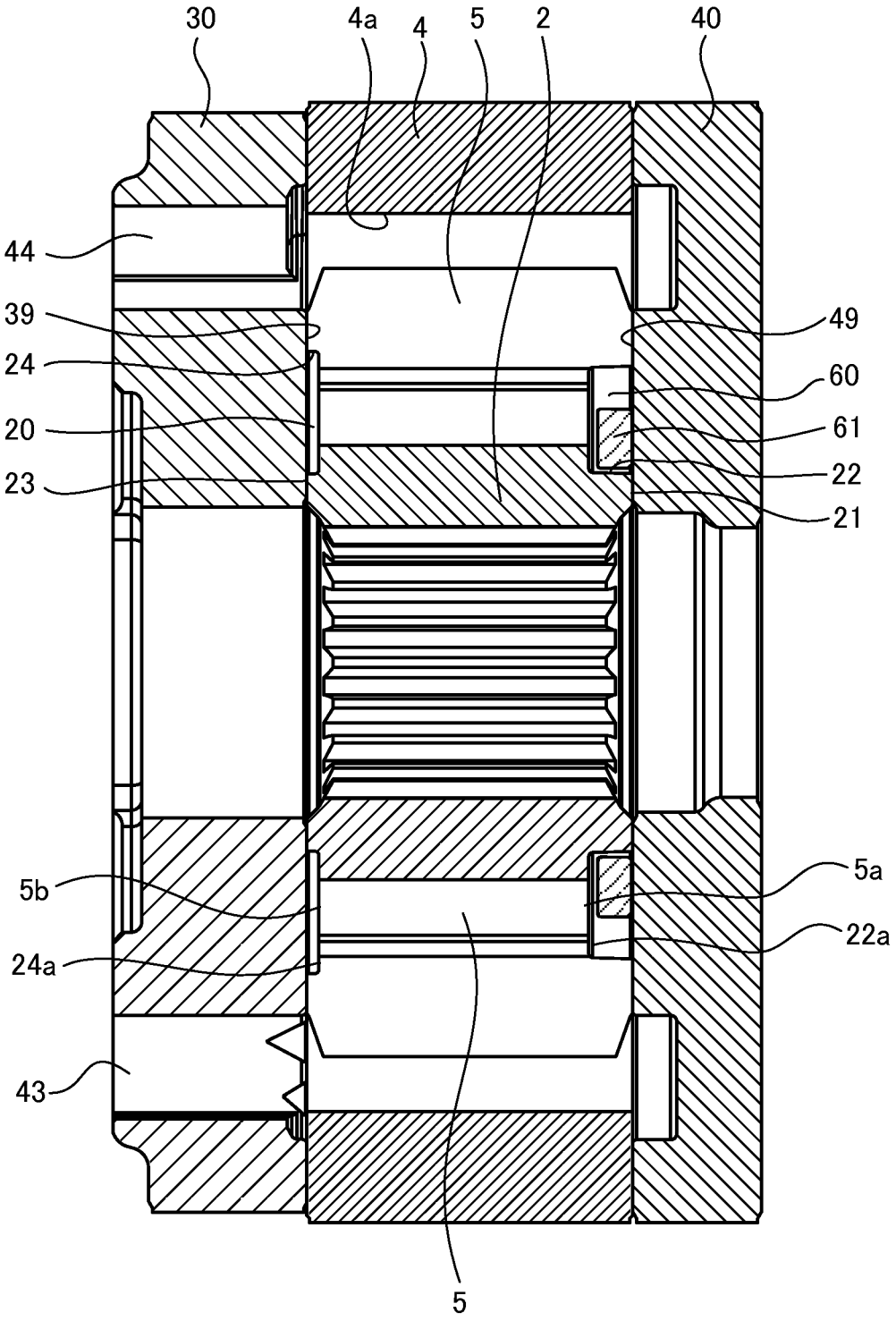
FIG. 4 is a sectional view of the rotor and the like, FIG. 5 is a perspective view of the rotor when viewed from behind.

As shown in FIG. 4, a vane ring housing chamber 60 is defined among the vane ring housing groove 22, the end surface 49 of the cover-side side plate 40 and the rotor 2. The pump discharge pressure produced in the discharge pressure chamber 18 is introduced to the vane ring housing chamber 60 through each discharge pressure introducing through hole 34 and each vane back pressure chamber 6.

A bottom part 22*a* of the vane ring housing groove 22 serves as a pressure receiving surface which pushes the rotor 2 backward (leftward in FIG. 1) with respect to a rotation axis direction of the rotor 2 when receiving the fluid pressure introduced to the vane ring housing chamber 60.

Figure 5:
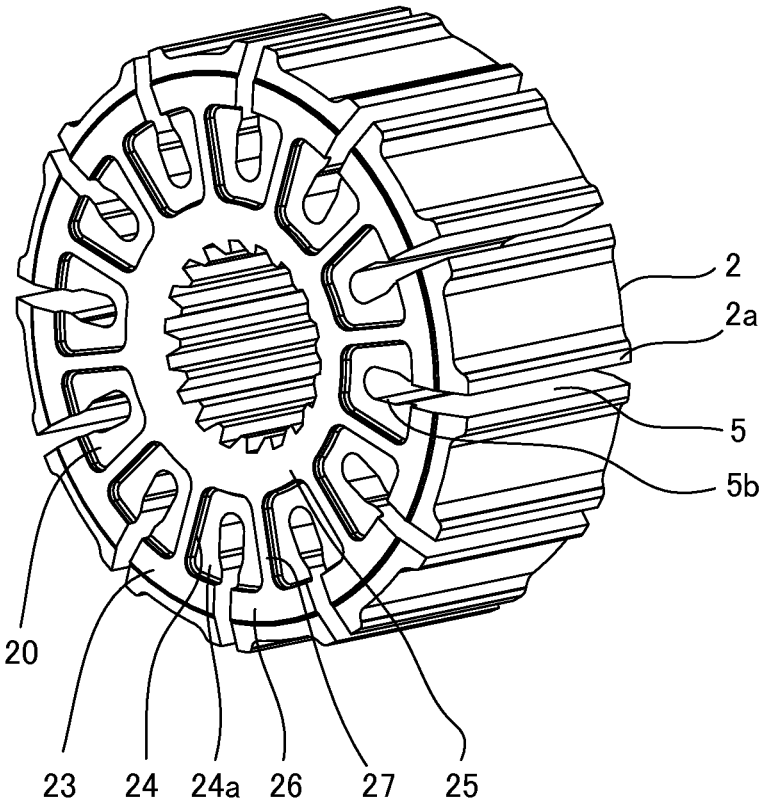

FIG. 5 is a perspective view showing a rear side (left side in FIG. 1) of the rotor 2. As many (twelve) slit opening recesses 24 as the vanes 3 are formed in a body-side end surface 23 of the rotor 2. Vane ring opposite pressure chambers 20 are defined among the slit opening recesses 24, the body-side side plate 30 and the vanes 3.

The slit opening recesses 24 are recessed in the body-side end surface 23 of the rotor 2. The rotor 2 includes, as parts surrounding the slit opening recesses 24, circular ring-shaped inner peripheral wall portion 25 and outer peripheral wall portion 26 extending concentrically with the rotation axis direction of the rotor 2 and radially extending partition wall portions 27 centered on the rotation center axis of the rotor 2.

Figure 6:
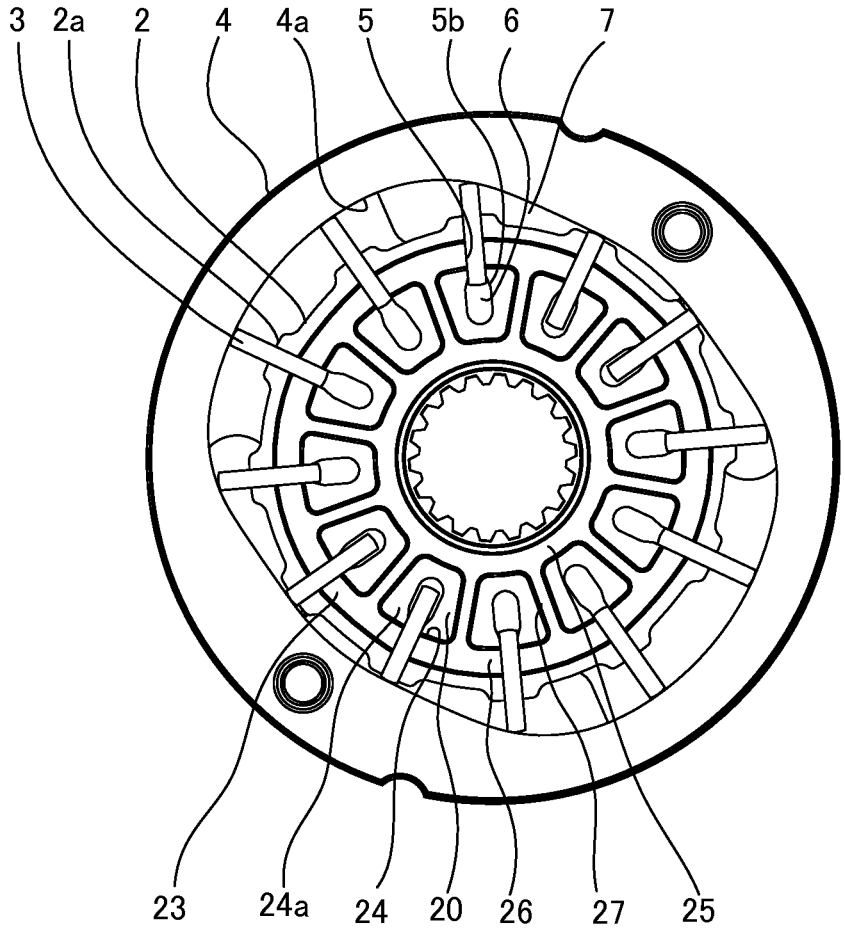
FIG. 6 is a rear view showing the interior of the vane pump.

FIG. 6 is a rear view of the rotor 2, the vanes 3 and the cam ring 4. The partition wall portions 27 are arranged at constant intervals in a circumferential direction and so formed that the opening areas of the slit opening recesses 24 are equal to each other. The slits 5 and the slit opening recesses 24 are radially arranged at constant intervals in the circumferential direction of the rotor 2.

The slit 5 is open from the bottom part 24*a* of the slit opening recess 24 to the outer peripheral surface 2*a* of the rotor 2 via the outer peripheral wall portion 26.

The vane ring opposite pressure chambers 20 are defined between the slit opening recesses 24 and the body-side side plate 30. The vane ring opposite pressure chambers 20 are defined by the slit opening recesses 24 recessed at every opening position of the slit 5 in the end surface 23 of the rotor 2, and as many (twelve) vane ring opposite pressure chambers 20 as the slits 5 are provided.

The bottom part 24*a* of the slit opening recess 24 serves as a pressure receiving surface for pushing the rotor 2 forward (rightward in FIG. 1) along the rotation axis direction when receiving the fluid pressure introduced to the vane ring opposite pressure chamber 20.

The total area (opening area) of the pressure receiving surfaces of the slit opening recesses 24 is set to be equal to the area (opening area) of the pressure receiving surface of the vane ring housing groove 22. Further, the areas of the opposite end surfaces 21, 23 of the rotor 2 are set to be equal to each other.

The opposite end surfaces 21, 23 of the rotor 2 are simultaneously ground at the time of manufacturing the rotor 2. Since the ground areas of the opposite end surfaces 21, 23 of the rotor 2 are equal, the opposite end surfaces 21, 23 of the rotor 2 can be evenly ground when opposite head surfaces of the rotor 2 are ground.

When the vane pump 1 is actuated, movements of the vanes 3 entering the slits 5 in the first and second discharge regions and movements of the vanes 3 projecting from the slits 5 in the first and second suction regions are repeated to expand and contract the vane back pressure chambers 6.

Since the expanding vane back pressure chambers 6 intermittently communicate with the back pressure ports 33 open on the body-side side plate 30 in the first and second suction regions, the pump discharge pressure is introduced from the discharge pressure chamber 18. By this pump discharge pressure, the vanes 3 project from the slits 5 and the tip parts of the vanes 3 slide in contact with the inner peripheral cam surface 4*a* to define the pump chambers 7.

In the first and second discharge regions, the working fluid is pressurized in the contracting vane back pressure chambers 6, flows out to the vane ring opposite pressure chambers 20 on the side of the body-side side plate 30 and flows out to the vane ring housing chamber 60 on the side of the cover-side side plate 40.

Since the back pressure ports 33 open on the body-side side plate 30 are not provided in the first and second discharge regions, the flow-out of the working fluid pressurized in the vane back pressure chambers 6 to the back pressure ports 33 through the vane ring opposite pressure chambers 20 can be suppressed. This enables the working fluid in the vane back pressure chambers 6 to be maintained appropriately high and enables the vanes 3 to smoothly follow the cam ring 4.

Since the vane ring 61 faces the openings of the slits 5 in wide ranges in the first and second discharge regions, the flow-out of the working fluid pressurized in the vane back pressure chambers 6 to the vane ring housing chamber 60 can be suppressed. This enables the working fluid in the vane back pressure chambers 6 to be maintained appropriately high and enables the vanes 3 to smoothly follow the cam ring 4.

Since the total area of the pressure receiving surfaces of the slit opening recesses 24 is set to be equal to the area of the pressure receiving surface of the vane ring housing groove 22, a force pushing the rotor 2 in the rotation axis direction is canceled out by the fluid pressures acting on the both pressure receiving surfaces of the rotor 2.

Since one end 5*a* of each slit 5 is open on the vane ring housing groove 22 and the other end 5*b* thereof is open on the slit opening recess 24, the vane ring housing chamber 60 and the vane ring opposite pressure chamber 20 communicate. This equalizes the pressure distributions of the fluid pressure in the vane ring housing chamber 60 and the fluid pressure in the vane ring opposite pressure chamber 20 and balances out a force pushing the rotor 2 backward (leftward in FIG. 1) by the working fluid received in the vane ring housing groove 22 along the rotation axis direction and a force pushing the rotor 2 forward (rightward in FIG. 1) by the fluid pressure received in the slit opening recesses 24. Thus, it is suppressed that the end surfaces 21, 23 of the rotor 2 are strongly pressed against the end surface 49 of the cover-side side plate 40 and the end surface 39 of the body-side side plate 30, sliding resistance of the rotor 2 can be suppressed low and the occurrence of seizure and the like in a sliding part can be prevented.

Functions and effects of the first embodiment are described below.

The vane pump 1 used as a fluid pressure supply source includes the rotor 2 which is driven and rotated, a plurality of slits 5 which are radially formed in the rotor 2, a plurality of vanes 3 which slidably project from the slits 5, the vane back pressure chambers 6 which are defined between the base end parts of the vanes 3 and the slits 5, the cam ring 4 with which the tip parts of the vanes 3 slide in contact as the rotor 2 rotates, the pump chambers 7 which are defined among the cam ring 4, the rotor 2 and the adjacent vanes 3, the suction pressure chamber 51 which introduces the working fluid to the pump chambers 7 expanding as the rotor 2 rotates, the discharge pressure chamber 18 which introduces the working fluid discharged from the pump chambers 7 contracting as the rotor 2 rotates, the vane ring 61 which faces the base end parts of the vanes 3, the vane ring housing chamber 60 on which the one end 5*a* of each slit 5 is open and in which the vane ring 61 is housed, and the vane ring opposite pressure chambers 20 on which the other ends 5*b* of the slits 5 are open and which cause the fluid pressure to act in a direction to push the rotor 2 toward the vane ring 61. (See FIGS. 1 to 8)

Since this allows the vane ring housing chamber 60 and the vane ring opposite pressure chambers 20 to communicate with each other via the slits 5, the fluid pressure distributions produced on the opposite sides of the rotors 2 are equalized, sliding resistance of the rotor 2 can be suppressed and the occurrence of seizure and the like in the sliding part of the rotor 2 can be prevented.

Further, the slit opening recesses 24 recessed at every opening position of the slit 5 are formed in the end surface 23 of the rotor 2 and the vane ring opposite pressure chambers 20 are defined between the slit opening recesses 24 and the body-side side plate 30 with which the rotor 2 slides in contact (see FIGS. 1 to 8).

This can suppress the flow-out of the working fluid in the vane back pressure chambers 6 contracted by the vanes 3 in the discharge regions to the vane ring opposite pressure chambers 20 and improve pump performance by maintaining the fluid pressure in the vane back pressure chambers 6 high.

Furthermore, the total area of the pressure receiving surfaces of the slit opening recesses 24 defining the vane ring opposite pressure chambers 20 and the area of the pressure receiving surface of the vane ring housing groove 22 are set to be equal (see FIGS. 1 to 8).

This can suppress sliding resistance of the rotor 2 by canceling out the force pushing the rotor 2 in the rotation axis direction by the fluid pressure acting on the opposite pressure receiving surfaces of the rotor 2 and can prevent the occurrence of seizure and the like in the sliding part of the rotor 2.

Furthermore, the back pressure ports 33 are provided which are open on the body-side side plate 30, with which the rotor 2 slides in contact, and introduce the pump discharge pressure to the vane back pressure chambers 6 via the vane ring opposite pressure chambers 20, and the back pressure ports 33 are provided only in the suction regions where the pump chambers 7 expand without being provided in the discharge regions where the pump chambers 7 contract (see FIG. 2).

Since the back pressure ports 33 are not provided in the discharge regions in this way, the flow-out of the working fluid pressurized in the vane back pressure chambers 6 to the back pressure ports 33 through the vane ring opposite pressure chambers 20 can be suppressed, and pump performance can be improved by maintaining the fluid pressure in the vane back pressure chambers 6 high.

Next, a second embodiment is described.

Figure 7:
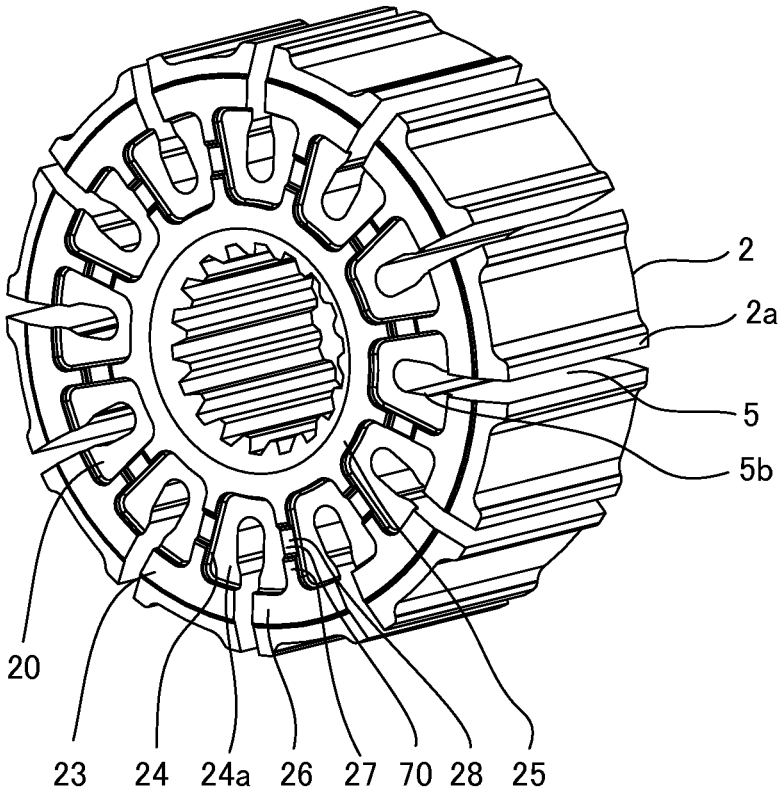
FIG. 7 is a perspective view of a rotor of a vane pump according to a second embodiment of the present invention when viewed from behind.
Figure 8:
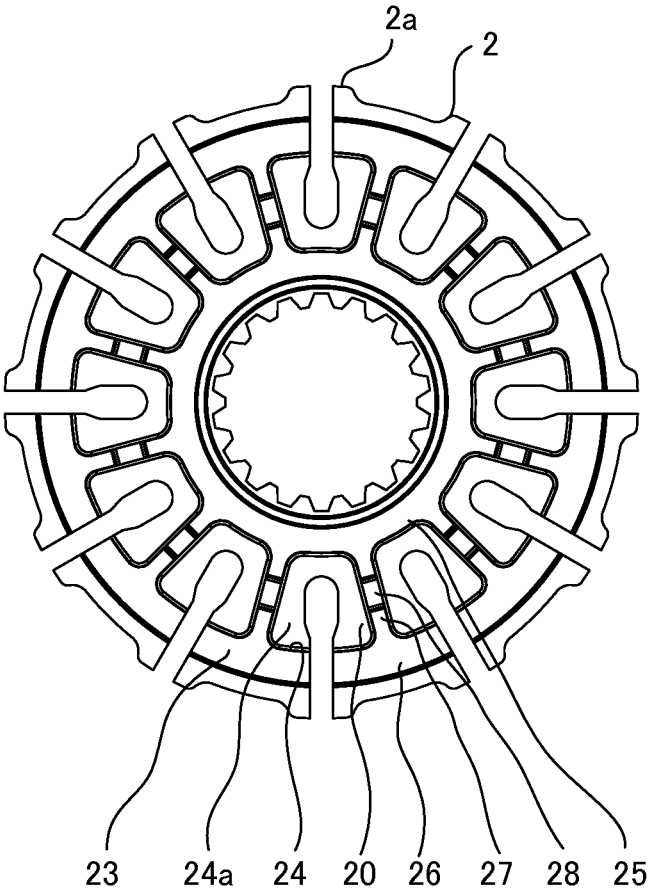
FIG. 8 is a rear view of the rotor.

FIG. 7 is a perspective view of a rotor 2. FIG. 8 is a rear view of the rotor 2. Since a vane pump of the present embodiment basically has the same configuration as in the first embodiment, only different components are described. It should be noted that the same components as in the first embodiment are denoted by the same reference signs.

In the present embodiment, communication grooves 28 are formed in partition wall portions 27 defining slit opening recesses 24, and throttle passages 70 are defined between the communication grooves 28 and a body-side side plate 30. Adjacent slit opening recesses 24 communicate with each other via the throttle passages 70.

It should be noted that communication holes (not shown) penetrating through the partition wall portions 27 may be formed and the throttle passages 70 may be defined by these communication holes.

Working fluid in a vane back pressure chamber 6 contracting in discharge region flows out from a slit 5 to a vane ring opposite pressure chamber 20 and flows out from the vane ring opposite pressure chamber 20 to an adjacent vane ring opposite pressure chamber 20 through the throttle passage 70. Since the throttle passages 70 throttle the flow of the working fluid between the adjacent vane ring opposite pressure chambers 20, a fluid pressure in the vane back pressure chambers 6 can be maintained appropriately high and vanes 3 can be allowed to smoothly follow a cam ring 4. This makes a pressure distribution on an end surface 23 of the rotor 2 facing each vane ring opposite pressure chamber 20 more uniform in a circumferential direction of the rotor 2, and the rotor 2 can be smoothly rotated by improving a pressure balance applied to the rotor 2.

The total area of pressure receiving surfaces of each slit opening recess 24 and each communication groove 28 is set to be equal to the area of a pressure receiving surface of a vane ring housing groove 22. This cancels out a force pushing the rotor 2 in a rotation axis direction by the fluid pressure acting on opposite pressure receiving surfaces of the rotor 2.

Functions and effects of the second embodiment are described below.

The vane ring opposite pressure chamber 20 includes the throttle passage 70 allowing communication between the adjacent slit opening recesses 24 (see FIGS. 7 and 8).

Since the flow rate of the working fluid flowing out from the vane ring opposite pressure chambers 20 due to the contraction of the vane back pressure chambers 6 in the discharge regions is adjusted by the throttle passages 70 in this way, the fluid pressure in the vane back pressure chamber 6 can be maintained appropriately high and pump performance can be improved. Thus, the pressure distribution on the end surface 23 of the rotor 2 facing each vane ring opposite pressure chamber 20 is made more uniform in the circumferential direction of the rotor 2, and the rotor 2 can be smoothly rotated by improving the pressure balance applied to the rotor 2.

The embodiments of the present invention described above are merely illustration of some application examples of the present invention and not of the nature to limit the technical scope of the present invention to the specific constructions of the above embodiments.

For example, in the above embodiments, the slit opening recesses 24 are formed in the body-side end surface 23 of the rotor 2 and the vane ring opposite pressure chambers 20 are defined among the slit opening recesses 24, the body-side side plate 30 and the vanes 3. Instead of this, slit opening recesses (not shown) recessed in the end surface 39 of the body-side side plate 30 may be formed and the vane ring opposite pressure chambers 20 may be defined between the slit opening recesses and the end surface 23 of the rotor 2.

Further, the cam ring 4 may be integrally formed on the pump body 10. Further, the body-side side plate 30 may be integrally formed on the pump body 10. Further, the cover-side side plate 40 may be integrally formed on the pump cover 50.

The present application claims a priority based on Japanese Patent Application No. 2011-219301 filed with the Japan Patent Office on Oct. 3, 2011, all the contents of which are hereby incorporated by reference.

The invention claimed is:

1. A vane pump used as a fluid pressure supply source, the vane pump comprising:

a rotor which is driven and rotated;

a plurality of slits which are radially formed in the rotor;

a plurality of vanes which slidably project from the slits;

vane back pressure chambers which are defined between base end parts of the vanes and the slits;

a cam ring with which tip parts of the vanes slide in contact as the rotor rotates;

a pump chamber which is defined among (i) the cam ring, (ii) the rotor and (iii) adjacent vanes;

a vane ring which faces the base end parts of the vanes;

a vane ring housing chamber on which one end of each slit is open and in which the vane ring is housed; and vane ring opposite pressure chambers on which the other ends of the slits are open and which cause a fluid pressure to act in a direction to push the rotor toward the vane ring;

wherein slit opening recesses recessed at every opening position of the slit are formed in an end surface of the rotor, and the vane ring opposite pressure chambers are defined between the slit opening recesses and a side plate with which the rotor slides in contact.

2. The vane pump according to claim 1, wherein the vane ring opposite pressure chamber includes a throttle passage allowing communication between adjacent ones of the slit opening recesses.

3. The vane pump according to claim 1, wherein the total area of pressure receiving surfaces of the vane ring opposite pressure chambers is equal to the area of a pressure receiving surface of the vane ring housing chamber.

4. The vane pump according to claim 1, further comprising:

a back pressure port which is open on the side plate, with which the rotor slides in contact, and introduces a pump discharge pressure to the vane back pressure chambers via the vane ring opposite pressure chambers, wherein the back pressure port is provided only in a suction region where the pump chambers expand.

* * * * *